United States Patent [19]

Widegren et al.

[11] Patent Number: 4,660,405

[45] Date of Patent: Apr. 28, 1987

[54] WORK RACK STRUCTURE

[75] Inventors: Tage K. Widegren; Tommy T. Ericsson, both of Eskilstuna, Sweden

[73] Assignee: Nicator AB, Eskilstuna, Sweden

[21] Appl. No.: 751,224

[22] Filed: Jul. 2, 1985

[51] Int. Cl.[4] ..... B21D 1/12

[52] U.S. Cl. ..... 72/447; 72/705

[58] Field of Search ..... 72/705, 447; 187/8.43

[56] References Cited

U.S. PATENT DOCUMENTS

| | | | |
|---|---|---|---|
| 3,048,237 | 8/1962 | Rutherford | 187/8.43 |
| 3,292,410 | 12/1966 | Baldassano | 72/705 |
| 3,518,867 | 7/1970 | Rouis | 72/705 |
| 4,313,335 | 2/1982 | Eck | 72/705 |
| 4,337,636 | 7/1982 | Clausen | 72/705 |
| 4,516,423 | 5/1985 | Reich | 72/705 |

FOREIGN PATENT DOCUMENTS

| | | | |
|---|---|---|---|
| 03373 | 10/1983 | PCT Int'l Appl. | 72/705 |
| 2027623 | 2/1980 | United Kingdom | 72/705 |

*Primary Examiner*—Lowell A. Larson

*Attorney, Agent, or Firm*—Young & Thompson

[57] ABSTRACT

A work rack structure for correcting and aligning misshapen vehicle frame and body portions having a modular structure consisting of several parts joinable and detachable to each other in a variety of combinations, including:

(a) a main rack structure frame part consisting of a pair of parallel tread members connected to each other by means of at least two cross bars underlying said tread members, (b) support bars for pulling equipment, each of which is telescopically slidable in said cross bars, (c) means for locking each of said support bar in a chosen position in its related cross bar, and (d) a jack-support carriage mounted for sliding movement between said tread members and above said cross bars. A method to set up the vehicle on the rack structure is also disclosed.

12 Claims, 7 Drawing Figures

WORK RACK STRUCTURE

BACKGROUND

This invention relates to a work rack structure for correcting and aligning misshapen vehicle frame and body portions and a method of fastening a car to be corrected and aligned on the rack structure.

The increasing traffic nowadays has caused an increasing need for alignments of cars, which have become warped because of a smash, diving into a ditch or the like. Work rack structures are mostly very bulky devices which take up a great deal of space. Even motor car workshops of relatively small dimensions have a demand for work rack structures for correcting and aligning cars or other vehicles and therefore there is a definite need for rack structures which are flexible, which are easy to move to be placed on different places within the workshop and which are able to be put away to take very little place when they are not needed.

In the U.S. Pat. Nos. 4,023,394 and 4,050,287 of the same applicants as the present invention, a method and an apparatus are described in which a rack is built up around a car, which is to be aligned, from separate beams easy to secure to the car and to each other. When the rack structure and the car have been connected to each other, the rack is lifted up in each end at the time by a movable lifting jack, and stands having selectable, presettable heights are placed under the rack. This rack has all the advantages mentioned above, but the mounting of a car by aid of it has many mounting steps. This is shown on FIG. 1, which shows the different mounting steps in serial order.

This rack includes a pair of crossing transverse beam members having wheels at its lower part and clamping members to be connected to the welding seams or rims on the vehicle underframe on its top. In order to connect these beam members to the vehicle (A) the front end of vehicle 101 is lifted up by a lifting jack 102

(B) the first transverse beam member 103 is rolled under vehicle 101 and its clamping members 104 are attached to the vehicle rims on each side of the car (C) car 101 is lowered and the lifting jack is taken away, and (D) moved to the back of the car to lift this end up (E) the other transverse beam member 105 is placed under the car and attached to its rims, and (F) the lifting jack is taken aside (G) a beam frame 106 is placed under the car and is attached to the two crossing transverse beam members 103 and 105

(H) one end of beam frame 106 is lifted up by lifting jack 102

(I) two stands 107 having heights settable in advance are placed under the frame on each side at the back side of it, and (J) the frame is lowered to rest on the back stands 107

(K) the lifting jack is moved to lift up the front side of the frame, and (L) stands 108 are placed also under the front end of the frame.

(M) As a result of these operations the car is placed on the rack in a height in which it is convenient for the operator to work with the car and with its wheels running freely.

The rack system described above is very flexible and adaptable to all possible kinds of motor cars but the mounting of the work rack structure on the car has many working moments and there is a need for a flexible work rack system having fewer working moments in mounting a car on it. The transverse beam members are projecting out laterally from the rack especially if the car mounted on it is a small-sized car, even when these are not used for the actual aligning operation for the car, which sometimes makes the operator irritated. There is also a need for a flexible working rack, which can be totally detached and put away when it is not needed but which does not have to be totally detached between alignment works on different cars if these cars are to be aligned one after another.

SUMMARY

The present invention solves these and other problems.

The main feature of the work rack structure proposed by the present invention for correcting and aligning misshapen vehicle frame and body portions is that it has a modular structure consisting of several parts joinable and detachable to each other in a variety of combinations, and includes a main rack structure frame part consisting of a pair of parallel tread members connected to each other by means of at least two cross bars fixed with their upper sides to the lower sides of said tread members, support bars for pulling equipment, each of which is telescopically slidable and lockable in a chosen position in said cross bars, at least three supporting stands having presettable lengths to be positioned in upright position under said rack structure frame. Preferably the rack structure has three or four cross bars and a lifting arrangement provided between two adjacent of said cross bars at least at one end part of said rack structure.

The lifting arrangement preferably has a first part to be placed at one of said cross bars and a second part placed at the cross bar next to said cross bar having said first part, one of said parts including a pivotal leg having a wheel means at its outer end, the other of said parts and said pivotal leg having a socket for a power cylinder to be placed between these elements. Each bar and tread member in said rack structure frame part preferably has at least one elongated through-hole extending practically along the whole of the element for passage of bolted joints to fasten the parts included in the modular system at a desired location along the element. Appropriately a carriage carrying a lifting means is disposed between said tread members and movable along them between the ends thereof. The lifting means comprises a pivotable lift jack which is movable in a transverse direction relative to the path of said carriage, said lift jack is pivotable from an upstanding active position to an inactive position where the lift jack is fully contained within said carriage which is disposed below the upper surfaces of the tread members. An integral upstanding chain anchor horn is provided on one end of said tread members opposite to the end part comprising the lifting arrangement, the other end of said tread members is provided with at least one attachment part of smaller width comprising only one through-slot for attachment of a separate chain anchor horn. Vehicle chassis clamps are preferably connectable to said tread members, each chassis clamp having an upper jaw part connectable to a rim on the underpart of a vehicle to be connected, said jaw part being pivotal around an axle perpendicular to the direction of said tread members, said chassis clamp having controllable locking means to lock said jaw part in a non-pivotal condition at control.

According to another feature of the present invention, a chassis clamp to be placed on a tread member having at least two parallel elongated throughholes between an upper side and a lower side of said tread member along the direction of it, includes an upper jaw part being pivotally mounted around an axle perpendicular to the extension of said tread member and adapted to be connected to a rim on the underside of a vehicle, a base plate having substantially the form of an isosceles triangle having its base along said tread member, said base plate having a first, a second and a third elongated through-hole, of which the first is extended substantially along the bisectrix of the top angle of the triangle and the second and the third are angled to the first and mutually mirror-inverted in relation to said first hole, and bolted joints to be placed through said holes in said tread member and said holes in said base plate. The upper jaw part and the base plate are preferably connected to each other by three legs, each leg having its lower part connected in the vicinity of an individual triangulation point of said base. Suitably, a controllable locking means is provided to lock said jaw part in a non-pivotal condition at control.

According to still another feature of the invention, the method to set a vehicle in an uplifted fixed position on a work rack structure for correcting and aligning the vehicle includes the following steps:

(a) setting a beam frame having a pair of parallel tread members connected by cross bars and having a carriage carrying lifting means movable along and between the ends of said tread members in an oblique position having supporting means in a position between the middle of said frame and one end of it and having its other end resting on the floor, (b) rolling up a vehicle to be operated on said tread members to be positioned on the frame, (c) lifting up said other end of said frame by means of a lifting arrangement provided between two adjacent of said cross bars at said other end and placing supporting means in a position between the middle of said frame and this end so that the frame resting on said supporting means will be placed in a horizontal position, (d) placing said carriage under one end of said vehicle and lifting this end up from said tread members, (e) connecting one chassis clamp means on each tread member both to a part of the chassis of said car at uplifted part and to the tread member in question, (f) moving said carriage under the other end of said vehicle and lifting this other end up from said tread members, (g) connecting another chassis clamp means on each tread member both to a part of the chassis of said car at its uplifted part and to the tread member in question.

Besides the above mentioned advantages of the invention regarding the assembling of the work rack structure and the securing of the car, the work rack structure according to the invention facilitates the aligning and straightening operations. The number and disposition of said support bars is designed to provide easy access to a number of attachment points for pulling equipment adequate for all normal operation. The integrated lifting means, the lifting arrangement and the supporting stands make it even possible to use the work rack structure for ordinary repair work in the workshop when no alignment operations are to take place.

BRIEF DESCRIPTION OF THE DRAWINGS

The illustrated embodiments may best be described by reference to the accompanying drawings where.

DESCRIPTION OF A PREFERRED EMBODIMENT

Figure 1:
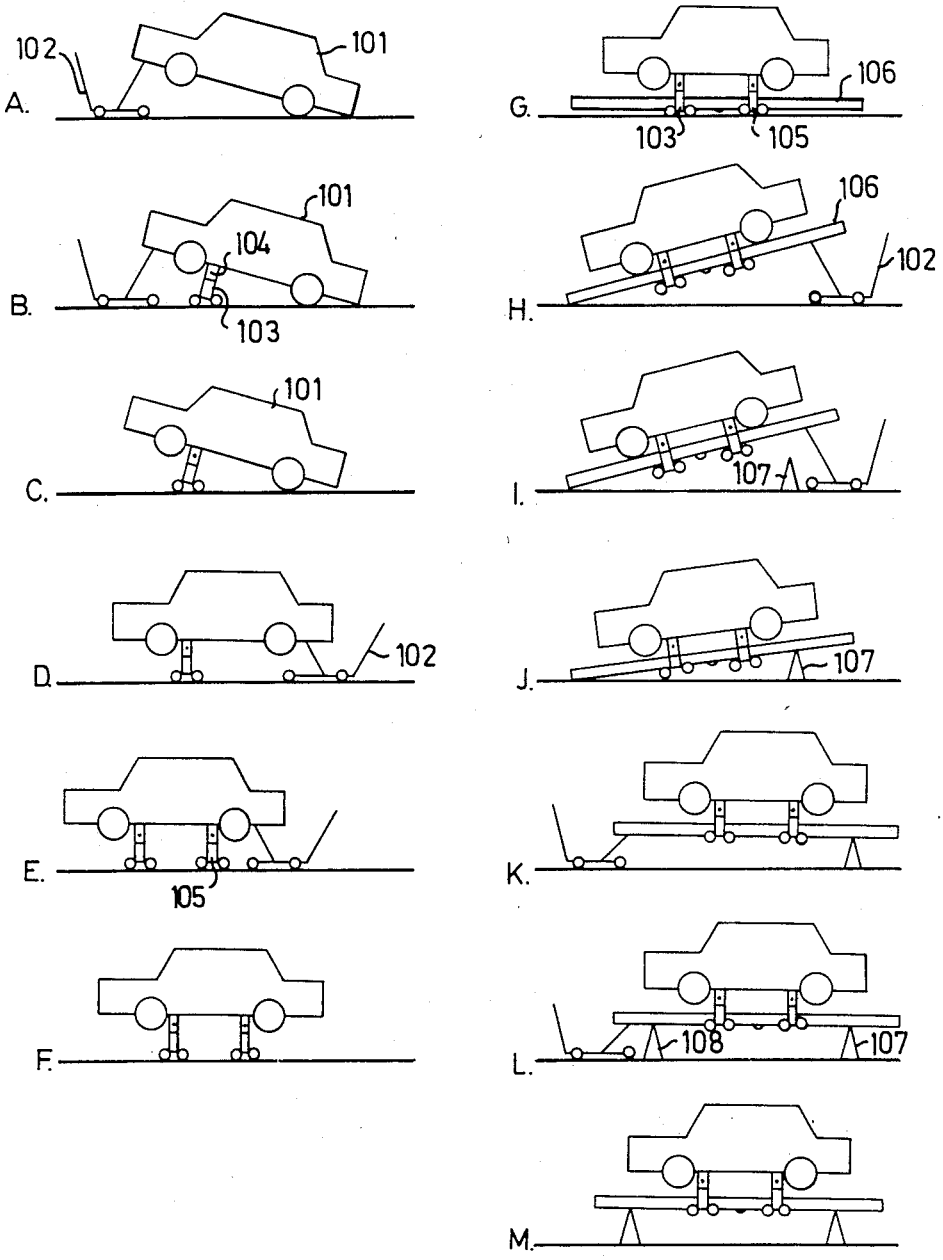
FIG. 1 PRIOR ART
FIG. 1 shows the series of consecutive steps of mounting a car in the prior art mentioned above.
Figure 2:
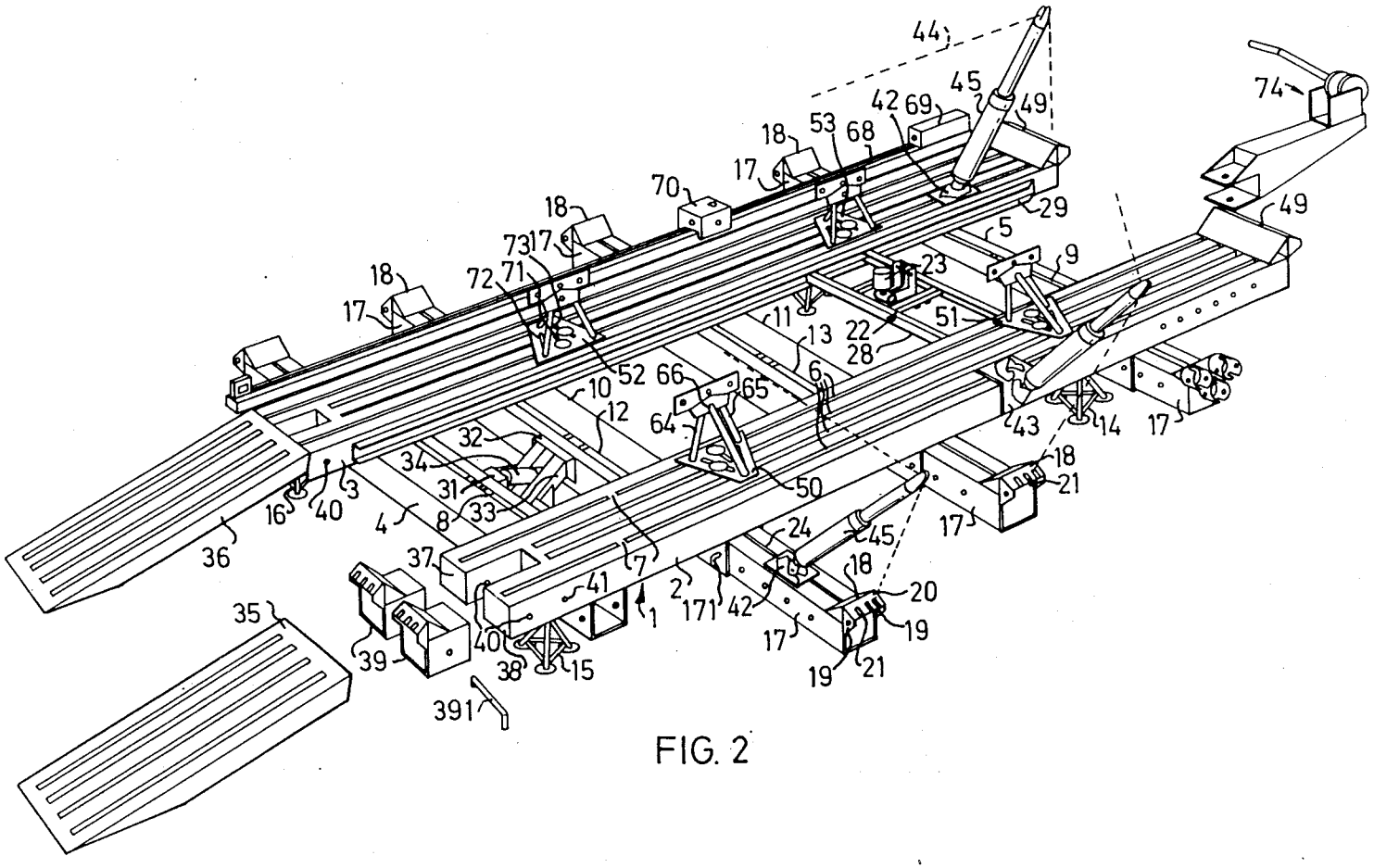
FIG. 2 is a perspective view of a working rack according to the invention having some detachably mounted accessories mounted on it.

In FIG. 2, a work rack structure for repairing and straightening misshapen vehicles is shown in. a joined and lifted position but without a car mounted on the rack. The rack contains several parts which are easily connectable to and detachable from each other in arbitrary positions. The basic part is a beam frame 1 having two parallel tread members 2 and 3, which are firmly connected to each other by means of cross bars 4 and 5 located near but not at their ends. The ends of the cross bars 4 and 5 are preferably welded to the tread members 2 and 3 and have their upper surfaces at the same level as the lower surfaces of the tread members.

Figure 5:
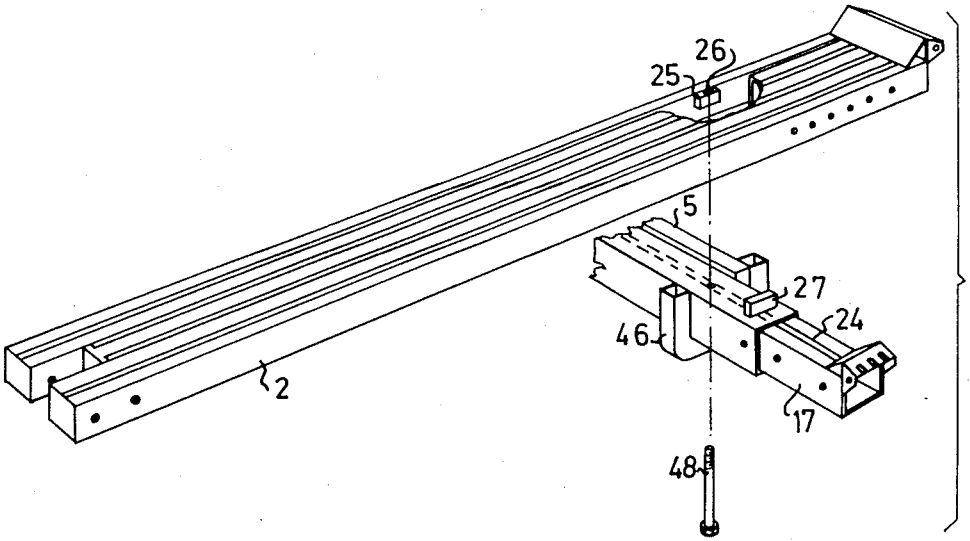
FIGS. 5 and 6 are a perspective view and a sectional view, respectively, of a connection between a tread member and a cross bar before respectively after assembling.
Figure 6:
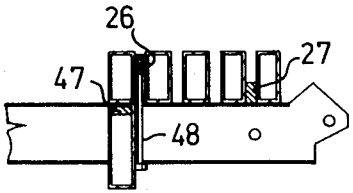

Both the tread members and the cross bars have vertical through-holes extended along the elements between their upper and lower surfaces. Preferably these bar elements are made of square pipes disposed side by side a small distance apart. The cross bars 4 and 5 comprise two pipes, one with the same dimension as the pipes of the tread members and the other with a greater width for containing support bars as will be explained later. Said wider pipes are flush with the outmost side surfaces of the respective tread member but the other pipes terminate some distance from these surfaces as can be seen in FIGS. 5 and 6. The tread members 2 and 3 have to be broad because the rack structure is intended to be used for motor cars of almost all sizes and be adapted to most widths between the wheels. From a manufacturing point of view it is advantageous to use the same kind of square pipes; the tread members therefore are composed of several pipes disposed side by side, five in the embodiment shown in FIG. 2. Therefore, the tread members have several rows of elongated through-holes 6. Principally, the through-holes 6 should be extended from one end to the other of the tread members, but since the tread members are rather long, the pipes would be individually resilient if they were not firmly connected to each other and therefore they are connected by weldings at at least one point 7 along their length. However, these welding points must not be located in line with each other, because the purpose of the elongated holes is that components shall be fixed to the tread members by bolted joints through their through-holes in any wanted position. The through-holes 8 and 9 in the cross bars 4 and 5, respectively, could be extended all over their length.

The beam frame 1 has also a pair of cross bars 10 and 11 located at predetermined distances from the bars 4 and 5, respectively, towards the center of the beam frame with their upper surface approximately on the same level as the lower surface of the tread members. The cross bars 10 and 11 have also elongated through-holes 12 and 13, respectively, and are of the same dimension as the cross bars 4 and 5. The cross bars are in one embodiment welded to said tread members.

A carriage 28 carrying a controllable lifting means 22 is placeable between the tread members 2 and 3 and is guided between the legs of a U-girder 29 welded onto the inside of each of the tread members 2 and 3. Thus, the carriage 28 can be moved between the ends of the tread members. The lower part of the carriage is disposed a distance above the upper surface of the cross bars to such an extent that it goes free from these bars even if they have a holder or the like on it fixed by means of a bolted joint. A lift jack 23 is supported in the carriage in such a manner to be movable in a direction transverse to the path of the carriage and to be pivotable about an axle in said transverse direction in such a way to be fully contained within the carriage when pivoted downwards as is diagramatically indicated in FIG. 2. In this position no part of the lift jack will protrude outside the carriage. It is to be noted that the shown position of the U-girder 29 on the tread members and the design of it shown in FIG. 2 is not the only thinkable and that the essential about the carriage 28 is that it is movable between the ends of the tread members having its lower part lifted up from the upper surface of the cross bars and has a height at a lowered position which allows it to be moved under a car standing on the tread members.

Support bars 17 for pulling equipment are inserted from opposite directions into the respective pipes of the cross bars having the greater width. The support bars have substantially half the length of the cross bars and are at their outer ends provided with integral upstanding chain anchor horns 18. These horns are in the preferred embodiment made of two flanges 19 of outwardly converging shape having a plate 20 joining the upper sloping surfaces together. One part, approximately two thirds, of these flanges 19 extends above the upper surface of the support bar at the end thereof and the other part is fixed to respective side of the support bar, preferably by welding. A reinforcement plate connects the upper surface of the support bar with the upper portions of said flanges 19 and the plate 20 joining these together in such a way that the reinforcement plate attains substantially the same slope as the upper surfaces of these flanges. The joining plate 20 is provided with slots 21 extending in the longitudinal direction of the support bar and having appropriate size to cooperate with the chains of the pulling equipment and is terminated before it reaches the outer ends of said flanges. The free ends of these flanges 19 are provided with holes for inserting locking pins in the transverse direction of the support bar for locking chains introduced in said slots.

In FIG. 2 another embodiment of an integral chain anchor horn is also shown. From the support bar 17 inserted in cross bar 5 a chain anchor horn comprising three hollow bodies of cylindrical shape project, in each of which two slots are provided for holding of chains.

The support bars 17 are built up from two square pipes spaced apart by a through-hole 24 extending over substantially whole of its length, as can be seen by the support bars shown extended from cross bars in FIG. 2. The support bars are telescopically slidable in the pipe of the cross bar with the greater width and have a plurality of holes in their sides for holding the support bars in predeterminated positions by insertion of a locking pin 171 into corresponding holes in the respective cross bar and into these holes.

Several modular parts may be attached to the beam frame 1, which preferably is placed on stands 14, 15,16 when an alignment operation of a misshapen vehicle is taking place. However, the stands shown in FIG. 2 are separate elements, and this is also to be preferred, but it also lies within the scope of this invention to have stands in the form of leg elements having adjustable lengths and being pivotally connected to the underside of the beam frame, which elements may be placed in an uplifted position under the frame and let down when the frame shall be in an uplifted position.

A beam frame lifting arrangement 30 is fixed on the cross bars 4 and 10, for example with the aid of holders fixed to the sides facing each other of those cross bars. It consists of a holder 31 having a socket and being fixed on the bar 4 and a holder 32 fixed on bar 10 and having a pivotally connected leg part 33 provided with at least one wheel at its outer end (not shown) and a socket in a middle part. A hydraulic lifting cylinder 34 of the kind normally used at the correction operations of a car is disposable between the sockets of the parts 31 and 33. The distance between the sockets when the working rack is in a non-lifted position is adapted to the length of the cylinder 34 in retracted condition. This is a preferred embodiment of a lifting arrangement but it is also within the scope of invention to have some other kind of lifting arrangement disposed at or near the cross bar 4.

Ramps 35,36 can be attached at one end of the beam frame and a winch 74 is connectable to the outer cross bar 5 at the other end. The tread members include preferably an uneven number of parallel bars, e.g. five as shown in FIG. 2, so that bars between pairs of bars can be terminated some distance from the ends of these pairs. The bars of each pair 37,38 are connected to each other at the ends. Each pair of bars and the intermediate bar are connected by weldings disposed a predetermined distance from the end of the tread members. In this way separate chain anchor horns 39 similar to the integral chain anchor horns can be connected to the back ends of the tread members. The length of the bar endings 37 and 38 is somewhat longer than what is needed for a chain anchor horn to be mounted thereon. The separate chain anchor horn 39 contains a square pipe length having a hole in each side aligned to each other. The endings 37,38 are provided with aligned holes 40,41, respectively, in their vertical sides. When a chain anchor horn intended for the alignment operation is thread over an ending, it is locked by a locking pin 391 inserted through the anchor horn sides and the holes of the ending. The ends of the tread members that are nearest the lifting arrangement are provided with those projecting pairs of pipes while the other ends preferably are provided with integral chain anchor horns 49 similar to those of the support bars.

Ram plate assemblies 42 with one socket or ram plate assemblies 43 with two sockets at right angles to each other are connectable to the elongated throughholes in the tread members and support bars, and chains 44 and lifting cylinders 45 being connected to fluid sources, are placed in a way known per se on said assemblies which will therefore not be described in further detail. Lifting cylinders, as well as stands, chains and separate fluid pumps are all parts of a standard equipment for work racks manufactured and for sale by the applicant.

To keep the working area as free as possible from fluid supply conduits it is advantageous to within the rack structure incorporate an integrated supply line system with a plurality of conveniently placed plug connectors for the conduits of lifting cylinders when it is foreseen that several lifting cylinders would be used for the pulling operations. The amount of external conduits will then be minimal.

As can be seen in FIG. 2 the work rack can be used both for straight (cylinders connected to plate assemblies 42) and oblique pulling operations (cylinder connected to plate assembly 43) and the rack is therefore sufficient for all normal operations. However, if it is desired to place a lifting cylinder in a position which is not attainable with the beam frame 1 or the support bars, a separate beam having a holder in one end and the same shape as the support bars, can be attached to one of the cross bars and one of the tread members in a desired oblique position.

In FIGS. 5 and 6 is shown an easily demountable connection between a tread member 2 and a cross bar 5 The cross bar 5 is near the outer end provided with a hollow U-beam 46 welded to the sides and bottom thereof. This beam has a square section with the same dimension as the width of the pipes forming the tread members and is disposed such a distance from the end to be in alignment with the innermost pipe of the tread member when assembled thereto. Immediately outside the U-beam 46 a hole is made in the top and bottom sides of the cross bar in the middle thereof which holes in assembled condition is aligned with a screw-threaded hole 26 in an assembling piece 25 that is disposed between the two innermost pipes of the tread member. The innermost pipe of the tread member is provided with two protrusions 47 of which one is shown in FIG. 6, with a square dimension similar to the inner dimension of the U-beam 46. These protrusions are disposed at the same distance from said assembling piece in order to be contained within the ends of the U-beam with a tight fit when the tread member 2 and the cross bar 5 are in assembled condition. The cross bar further comprises another assembling piece 27 fixed to the upper side and disposed such a distance from the end thereof to fit in between the two outermost pipes of the tread member. In assembled condition a bolt 48 with a screw-threaded end secure the tread member and the cross bar firmly together. Before the insertion of said bolt the support bar 17 must obviously be placed within the cross bar since the bolt is adapted to go through the through-hole 24 of said bar. The bolt therefore serves also as an end stop for the support bar and prevents it from falling out of the cross bar. This easily demountable connection is intended to be used for work racks in those workshops where realigning and measuring operations are not so frequent as to motivate an always assembled work rack and where furthermore storing space is limited. For other workshops welding joints are preferred at present, which joints can be made when the work rack for the first time is assembled in the workshop in question.

Figure 4:
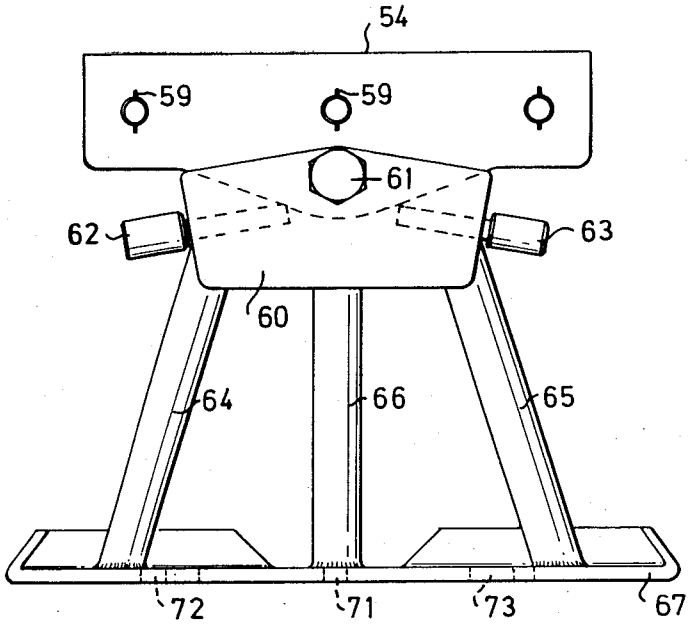
FIGS. 3 and 4 are a side view, partly in section, and a front view, respectively, of a chassis clamp to connect a car to the rack.
Figure 3:
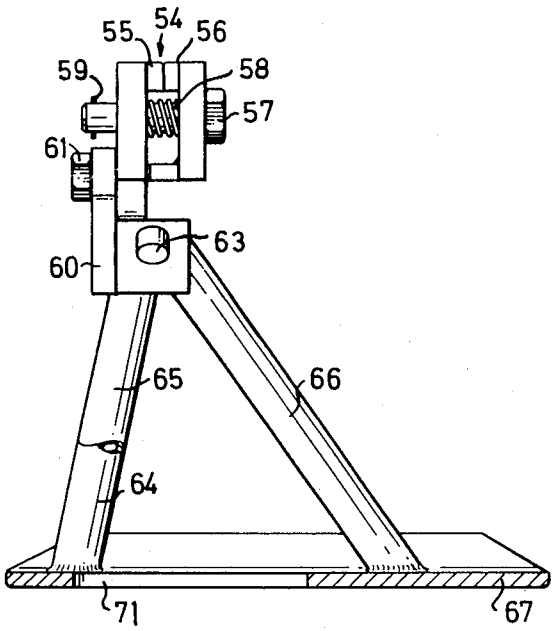

Four chassis clamps 50,51,52,53 are connectable on the tread members by means of bolted joints. FIGS. 3 and 4 show a side view and a front view, respectively, of a clamp. The clamps are intended to be connected to the welding seams or rims on a vehicle underframe on its top 54. The top 54 includes two opposite jaws 55,56 of which one 55 is fixed on the clamp and the other 56 is movable to and fro the fixed jaw 55 by means of three bolts 57 inserted through smooth holes in the movable jaw 56 screwed in threaded holes in the fixed jaw 55 and having a pressure spring 58 around its shank between the jaws and a stop pin 59 at its back end. The operator uses an automatic wrench both to connect and to disconnect a car rim to the jaws, and the stop pin is intended to prevent the bolts from being totally screwed out during the disconnection operation.

The top 54 is rounded in its lower part and is pivotally mounted on the head 60 of the clamp support by means of an axial bolt 61. Two stop screws 62,63, having well grippable heads are provided on each side of the support near the top and are screwable to a position in which the inner ends of the screws are abutting to the lower part of the top end to prevent it from pivoting in this position. The intention of this feature will be described further in the description.

The supporting three legs 64,65,66, which are inclined and fixed on a substantially triangular plate 67 being an isosceles preferably arcuate angle triangle with its base along the extension of the tread members, the leg 66 being extended in a plane perpendicular to the tread member 2 near the top of the triangle, and the other legs 64,65 having their base parts wide apart and connected to the plate 67 near the ends of the base. The legs have a small cross section in order to provide as little barrier as possible for the light beam from the measuring device placed on a bar 68 disposed in parallel relationship to tread member 3, the measuring device including a laser 69 fixed on the end of the bar and a light-deflection device 70 movable along the bar and having a few different light-deflection angles settable in steps. A measuring device of this kind is known per se and is described in the copending U.S. patent application Ser. No. 256,909.

The triangular plate has three oblong holes 71, 72,73, of which one 71 is extended along the bisectrix of the acute top angle and the other two are extended between the lower part of the back leg 66 and the lower part of the side legs 64 and 65, respectively. Having this hole configuration, the plate can be placed in any position laterally on the tread members connected to it by means of bolted joints through the holes in the plate and in the tread members. Because of the nonparallelism of the plate holes 71 to 73, a tendency of the chain clamps 50 to 53 to move laterally on the tread members at mechanical stress is avoided.

A winch 74 is mounted on the bar 5.

As mentioned above, the rack can, but does not, need to be totally demounted between alignment work on different cars and thus the rack having for instance the following details may be standing stationary at a suitable place in the workshop: the beam frame 1 with inserted support bars, a stand 14 under each tread member 2 and 3, the winch 74, the carriage 28 with the lifting means and the beam frame lifting arrangement 30.

Figure 7:
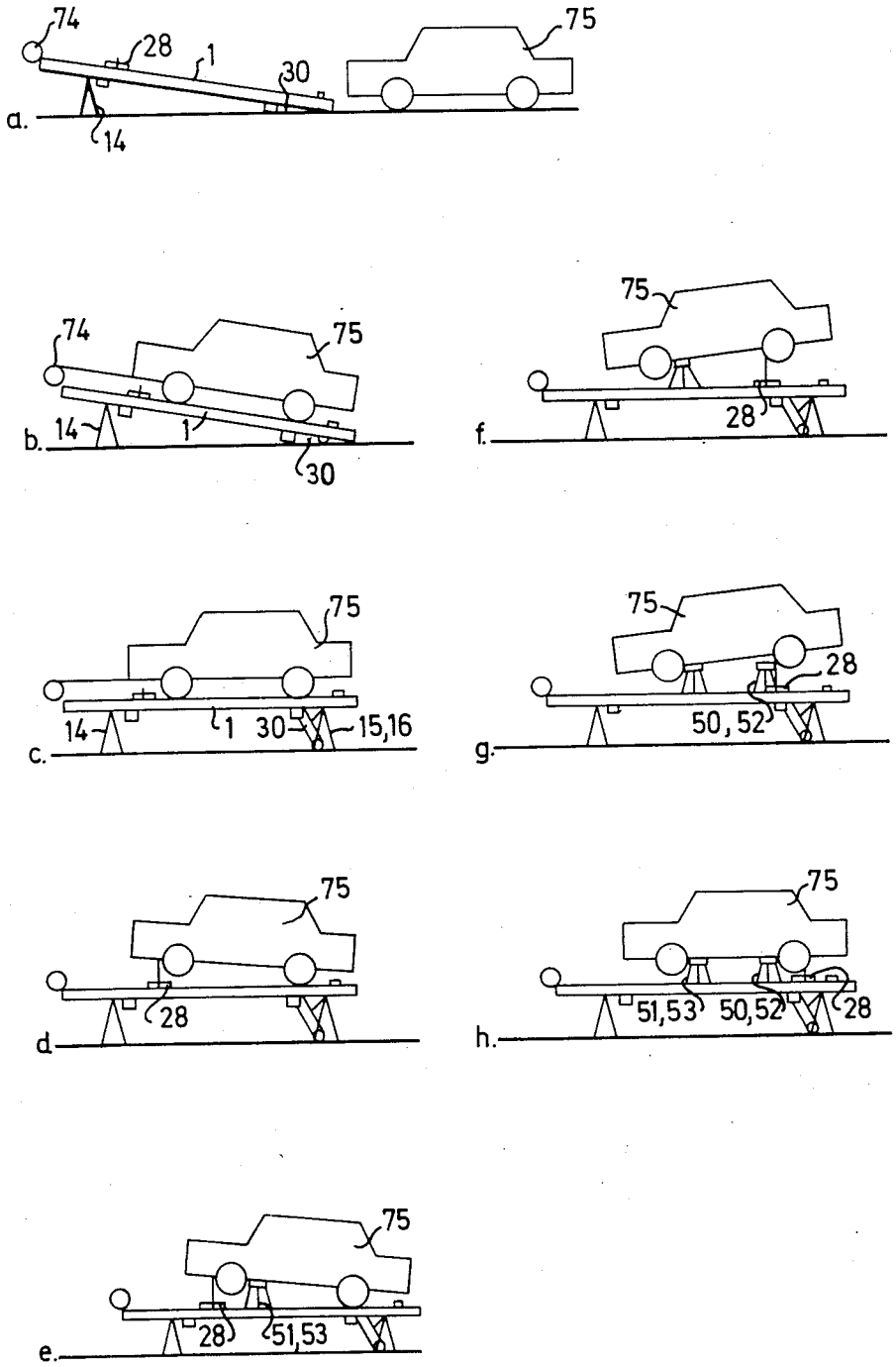
FIG. 7 shows a series of consecutive steps of mounting a car on a working rack according to the invention.

The steps of mounting a car 75 on the work rack structure according to the invention are now to be described with reference to the serial representation FIG. 7:

(a) The rack has one end lowered and the car 75 to be fastened on the rack is placed at the lowered end of the rack.

(b) The winch cable is connected to the front or the back of the car 75 depending on which part is most damaged, and the car is driven up on the tread members drawn by the winch 74. (If the car can be driven, the use of the winch is unnecessary.)

(c) The beam frame lifting arrangement 30 lifts the lowered back end of the rack 1 in an elevated position, the stands 15,16 are placed under the tread members, the beam frame lifting arrangement 30 lowers the back end to rest upon the stands and the cylinder 34 (see FIG. 2) may be detached to be used later on in the alignment devices.

(d) The carriage 28 with the lifting means is moved into position to lift the front or back end of the car 75.

(e) The front chassis clamps 51 and 53 are mounted on the tread members such that each having its top directly under a rim of the car 75, the lifting means on the carriage 28 is lowered until the rims of the car are resting in the jaws of the top, the top in this position being inclined because the car is inclined, and the jaws are pressed to each other by screwing up the bolts 57. The screws 62 and 63 are screwed out so that the top is free to rotate (see FIGS. 3 and 4).

(f) The carriage 28 with the lifting means is lowered and moved backwards into a position to lift the back or the front of the car.

(g) The back chassis clamps 50 and 52 are fastened onto the tread members in a position in which their tops are placed directly under a rim of the car 75.

(h) The back end of the car 75 is lowered such that the rims are placed between the jaws of the tops, the bolts 57 are screwed on, the screws 62,63 on each chassis clamp 50,51,52,53 are screwed in to lock the top of the clamp, and the car is in position to be aligned.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

We claim:

1. A work rack structure for correcting and aligning misshapen vehicle frame and body portions, having a modular structure comprising several parts joinable to and detachable from each other in a variety of combinations, comprising:

a main rack structure frame part comprising a pair of parallel tread members connected to each other by means of at least two hollow cross bars underlying said tread members, a carriage carrying lifting means disposed between said tread members and movable along and between said tread members and above said cross bars, wherein each bar and tread member in said rack structure frame part has at least one elongated through-hole extending along substantially the whole of the element for passage of bolted joints to fasten the parts included in the modular system at a desired location along the element, chassis clamps attachable to said frame part for rigidly connecting a vehicle to said frame part, and support bars for pulling equipment connected to each of asid cross bars and telescopically slidable therein between a retracted storage position and an extended operative position.

2. A work rack structure according to claim 1, wherein each of said support bars for pulling equipment extends only half the length of said cross bars whereby only an integral upstanding chain anchor horn on the outer end of said support bar projects from the main rack structure in the fully inserted position of said support bar, each cross bar containing two support bars introduced into opposite ends thereof.

3. A work rack structure according to claim 1, wherein said lifting arrangement has a first part adapted to be placed at one of said cross bars, and a second part adapted to be placed at the cross bar next to said cross bar having said first part, one of said parts including a pivotal leg having a wheel means at its outer end, the other of said parts and said pivotal leg having a socket to receive a power cylinder between these elements.

4. A work rack structure according to claim 1, wherein the tread member is comprised of spaced parallel pipes and the connection between said tread member and said cross bars comprises a bolted joint, said joint including a hollow U-beam straddling said cross bar from below and fixed thereto, the ends of said beam cooperating with protrusions downwardly projecting from the tread member, two assembling pieces disposed between the two innermost and outermost pipes of the tread member, respectively, of which said inner assembling piece is fixed to the tread member and connected to the cross bar by a bolt introduced through corresponding holes in the cross bar and in said inner piece and said outer assembling piece is fixed to the top side of said cross bar.

5. A work rack structure according to claim 1, wherein the lifting means comprises a pivotable lift jack which is movable in a transverse direction relative the path of said carriage, said lift jack being pivotable from an upstanding active position to an inactive position wherein the lift jack is fully contained within said carriage which is disposed below the upper surfaces of the tread members.

6. A work rack structure according to claim 1, wherein each of said tread members has a width which is at least twice the width of each of said cross bars, and an integral upstanding chain anchor head is provided on one end of said tread members opposite to the end part comprising the lifting arrangement, the other end of said tread members being provided with at least one attachment part of smaller width comprising only one through-slot for attachment of a separate chain anchor horn.

7. A work rack structure according to claim 1, wherein each of said chassis clamps has an upper jaw part connectable to a rim on the underside of a vehicle to be corrected, said jaw part being pivotable around an axis perpendicular to the direction of said tread members, said chassis clamp having controllable locking means to lock said jaw part in a non-pivotal condition.

8. A work rack according to claim 1, and a separate pull device carrying beam means having a holder at one end connectable to one of said tread members or to one of said cross bars and including an elongated through-hole, said pull device being connectable by said holder and a bolted joint through its hole and one of said holes in said tread members or cross bars, said beam means having its upper side substantially on the same level as the lower side of said tread members.

9. A work rack structure according to claim 1, and at least three supporting stands having presettable lengths adapted to be positioned in upright position under said rack structure frame.

10. A work rack structure according to claim 1, and a lifting arrangement provided between two adjacent of said cross bars at least at one end parts of said rack structure for lifting said end part.

11. A chassis clamp to be placed on an elongated tread member having at least two parallel elongated through-holes between an upper side and a lower side of said tread member along the length of asid tread member, including (a) an upper jaw part pivotally mounted about an axis perpendicular to the length of said tread member and adapted to be connected to a rim on the underside of a vehicle, (b) a base plate having substantially the form of an isosceles triangle having its base along said tread member, said base plate having a first, a second and a third elongated through-hole, of which the first is extended substantially along the bisectrix of the top angle of the triangle and the second and the third are angled to the first hole and mutually mirror-inverted in relation to said first hole, and (c) bolted joints adapted to be placed through said holes in said tread member and said holes in said base plate, wherein said upper jaw part and said base plate are connected to each other by three legs, each leg having its lower part connected in the vicinity of an individual triangulation point of said base base.

12. A chassis clamp according to claim 11, and controllable locking means to lock said jaw part in a non-pivotal condition.

* * * * *